US005759098A

United States Patent [19]

Jarnot

[11] Patent Number: 5,759,098

[45] Date of Patent: Jun. 2, 1998

[54] PUSH-IN COVER VENT

[76] Inventor: Frank R. Jarnot, P.O. Box 3494, Lantana, Fla. 33465

[21] Appl. No.: 831,334

[22] Filed: Mar. 31, 1997

[51] Int. Cl.[6] ..... F24F 13/20

[52] U.S. Cl. ..... 454/275; 135/93; 454/118; 454/276; 454/367

[58] Field of Search ..... 454/77, 79, 88, 454/118, 275, 276, 277, 339, 367, 370; 135/93; 2/DIG. 1

[56] References Cited

U.S. PATENT DOCUMENTS

| | | | |
|---|---|---|---|
| 3,013,483 | 12/1961 | Knight . | |
| 3,024,717 | 3/1962 | Rozek . | |
| 3,164,078 | 1/1965 | Sheng | 135/93 X |
| 3,345,932 | 10/1967 | Sauer . | |
| 3,892,169 | 7/1975 | Jarnot . | |
| 4,184,414 | 1/1980 | Jarnot . | |
| 4,898,085 | 2/1990 | Jarnot . | |
| 5,328,405 | 7/1994 | Jarnot | 454/78 |

*Primary Examiner*—Harold Joyce
*Attorney, Agent, or Firm*—Jacobson, Price, Holman & Stern, PLLC

[57] ABSTRACT

A one-piece air circulation vent for piercing and maintaining a ventilation opening in a flexible cover or the like. The vent includes a stiff, but resilient body structure which comprises a main panel member generally triangular in plan and defining convergent side edges and an apex facing in the forward direction. The main panel member is arched transversely of the forward direction and has a generally V-shaped slot formed therein including convergent legs generally paralleling the convergent side edges of the panel member. The V-shaped slot defines the main panel into a generally triangular central cutting section and a peripheral retaining section. The side edges of the central section converge toward a sharpened apex inward of the apex of the panel member. The central section with its sharpened apex is slightly deflectable relative to the remainder of the panel member. The rear of the body structure has a louvered rear panel to allow air circulation into and out from underneath the cover.

20 Claims, 3 Drawing Sheets

PUSH-IN COVER VENT

CROSS-REFERENCE TO RELATED APPLICATIONS

Not applicable

STATEMENT REGARDING FEDERAL SPONSORED RESEARCH OR DEVELOPMENT

Not applicable

BACKGROUND OF THE INVENTION

1. Field of the Invention

This invention relates to a vent construction and, more particularly, to a vent construction for use in conjunction with flexible covers such as plastic sheets and other covering sheets used to cover materials and/or equipment at a job site or manufacturing plant and the like. Also, the vent may be used for venting car and boat covers and the like.

2. Description of Related Art

The following prior U.S. patents disclose vent covers of various constructions and which may be used in substantially the same environments as the vent cover of the instant invention, but which do not include the improvement features of this invention:

| | | |
|---|---|---|
| 3,013,483 | Knight | December 19, 1961 |
| 3,024,717 | Rozek | March 13, 1962 |
| 3,345,932 | Sauer | October 10, 1967 |
| 3,892,169 | Jarnot | July 1, 1975 |
| 4,184,414 | Jarnot | January 22, 1980 |
| 4,898,085 | Jarnot | February 6, 1990 |
| 5,328,405 | Jarnot | July 12, 1994 |

The patents to Knight U.S. Pat. No. 3,013,483 and Rozek U.S. Pat. No. 3,024,717 disclose vents for covers wherein the vents are rigid or semirigid and can only be used in specific areas of the covers which have vent openings formed therein and which have mounting structure for the vents specifically added thereto.

The patent to Sauer U.S. Pat. No. 3,345,932 discloses a vent for a cover having a preformed opening therein, and the vent is secured in place by adhesive or stitching. The patent discloses one form of vent where a portion of the vent is secured to the inner side of the cover by adhesive.

The patents to Jarnot U.S. Pat. Nos. 3,892,169 and 4,184,414 disclose vents for covers which require preformed openings in the associated covers and wherein the vents include cover inner side and cover outer side components which must be snapped together through the cover openings. The patent to Jarnot U.S. Pat. No. 5,382,405 discloses a panel vent utilizing a semipermanently mounted annular base assembly requiring extensive mounting procedures.

Finally, the patent to Jarnot U.S. Pat. No. 4,898,085 discloses a two piece push-in flexible cover vent having some of the characteristics of the instant invention. However, the prior cover vent is not sufficiently resilient to afford enhanced vent-to-cover locking upon completion of the installation of the vent in the cover and further does not provide other features which are desirable in a cover vent. Such features include (1) one piece construction to reduce cost and enhance ease of manufacture, (2) protection for the cover piercing point of the vent against damage after installation of the vent into the cover, (3) maintenance of the edges of the cover defining the slit therein effected by installation of the vent in a widely separated condition in order to afford maximum ventilation, and (4) improved securement of the vent in the associated cover.

SUMMARY OF THE INSTANT INVENTION

The cover vent of the instant invention comprises a one piece body structure which may be molded of any suitable plastic or other material. Therefore, the vent of this invention may be inexpensively produced. The one piece structure includes a stiff, but resilient, main panel member which is generally V-shaped or triangular in plan. The divergent side edges of the main panel member are preferably longer than the rear end, or the spacing between the divergent ends of the side edges. The main panel member is arched transversely of a path bisecting the apex thereof and includes a convex outer side and a concave inner side. In addition, the panel member includes a generally V-shaped slot formed therein which extends from near the apex back toward the rear of the panel body. The slot includes divergent legs paralleling the diverging side edges of the panel but is spaced slightly inward thereof. Hence the V-shaped slot generally divides the main panel member into a generally triangular central section and a peripheral section.

The apex of the central section defined by the V-shaped slot is preferably sharpened to a point for piecing the cover when inserting the vent. The side edges of the central section formed by the V-shaped slot are also formed into sharpened or cutting edges. Thus, when the central section is depressed with respect to the peripheral section due to the resiliency of the panel member from which the central and peripheral sections are formed by the defining V-shaped slot, the sharpened apex point of the central section is in position to pierce a cover sheet as the vent is slid forwardly on the surface of the cover sheet. Once the cover sheet is pierced, the outward tapering of the edges or the widening of the central section cut the cover sheet to form a slit opening therein as the vent is advanced into the cover. The central cutting section thus progresses into the slit opening on one side of the cover sheet, normally the inside side, and the peripheral section slides along the other side of the sheet, normally on the outside side.

The vent is preferably moved into the cover until the edge of the slit cover sheet on top of the central section and below the peripheral section engages the ends of the V-shaped slot. Once in position, the biasing of the central section with respect to the peripheral section toward their at rest positions in the resilient main panel members serves to retain the vent in position within the cut slit opening in the cover sheet. The rear of the vent preferably has a rear end panel with ventilating slots for air to escape from underneath the cover sheet and inside the vent.

The sharpened cutting edges of the central cutting section defining the inner margins of the legs of the slot are preferably serrated to assist in cutting the cover sheet as the vent advances in penetrating the cover sheet. Further, the divergent ends of the legs of the V-shaped slot preferably include opposing lateral slot extensions for receiving and holding the edge ends of the slit opening formed in the associated cover panel.

Accordingly, an object of the present invention is to provide a one piece cover vent construction for forming and maintaining open a slit opening in a flexible cover sheet whereby ventilation into and out of cover can be provided.

Another object of this invention is to provide a cover vent construction in accordance with the preceding object which does not require tools to effect installation of the vent into a flexible cover sheet.

Yet another object of this invention is to provide a one piece cover vent construction which will automatically lock in position in the associated cover sheet upon completion of the installation process.

A further object of this invention is to provide a cover vent construction in accordance with the preceding objects and which is constructed of stiff but slightly resilient material, is arcuate in cross-sectional shape and includes abutments with which finger pressure may momentarily decrease the radius of curvature of the vent construction during final installation thereof for the purpose of enhancing the ability of the vent to releasably engage with the associated cover sheet in a locking relationship.

Another object of this invention is to provide a cover vent construction which includes a cover piercing and cutting element for use in forming the slit opening in the associated cover sheet, during initial installation thereof, and with the vent construction ensuring that the slit opening in the associated cover sheet remain open subsequent to installation of the vent.

A final object of this invention to be specifically set forth herein is to provide a cover vent construction in accordance with the preceding objects which will conform to conventional forms of manufacture, be of simple construction and materials and easy to install so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
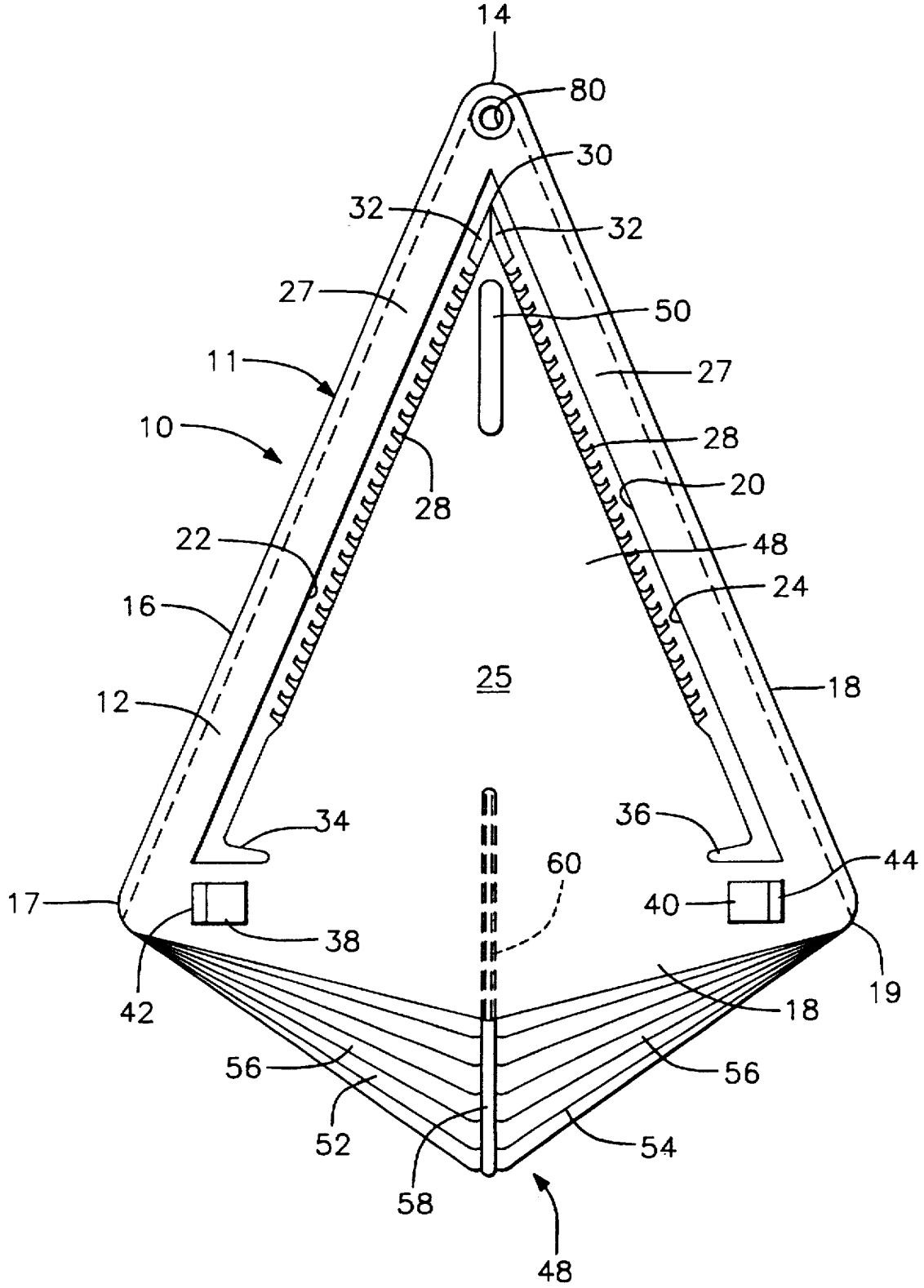
FIG. 1 is a plan view of the preferred embodiment of the vent construction of the present invention.
Figure 2:
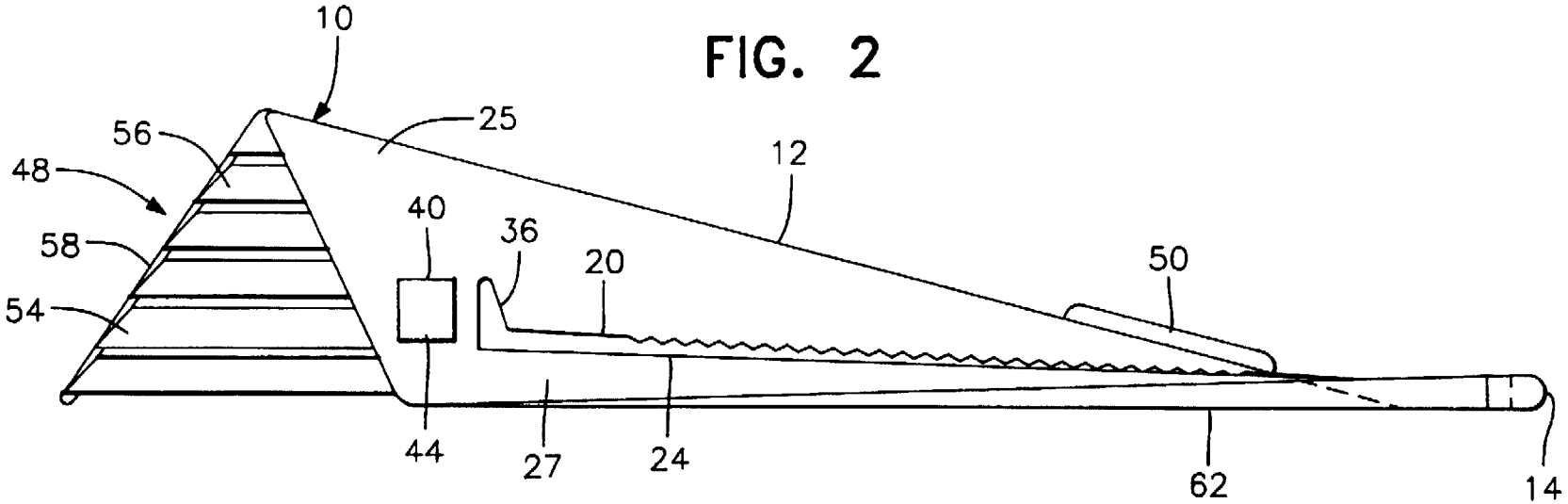
FIG. 2 is a right side elevational view of the vent construction of FIG. 1.

Referring now more specifically to the drawings, the numeral 10 generally designates the push-in vent of the instant invention. The vent 10 is made of a one piece body structure generally designated by the numeral 11 molded or formed from any suitable material, such as moldable plastics or the like. The body structure includes a main panel member 12 which is generally V-shaped in plan including a forward rounded apex 14 and rearwardly divergent side edges 16 and 18. The panel member 12 preferably has a maximum width between corners 17 and 19 which is slightly less than the length of one of its side edges 16 and 18.

Figure 4:
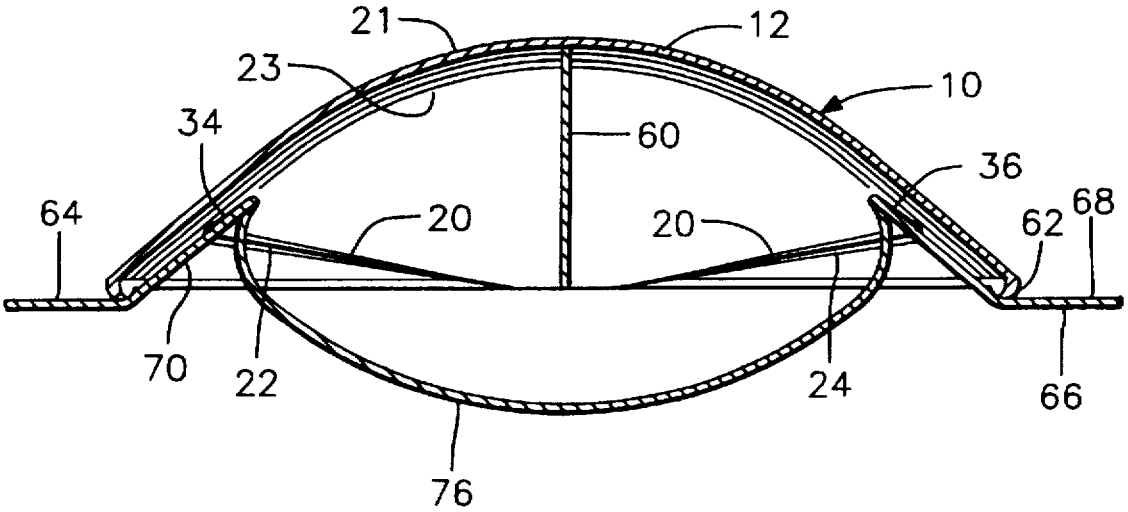
FIG. 4 is a sectional view taken substantially upon the plane indicated by the section line 4—4 in FIG. 3.
Figure 5:
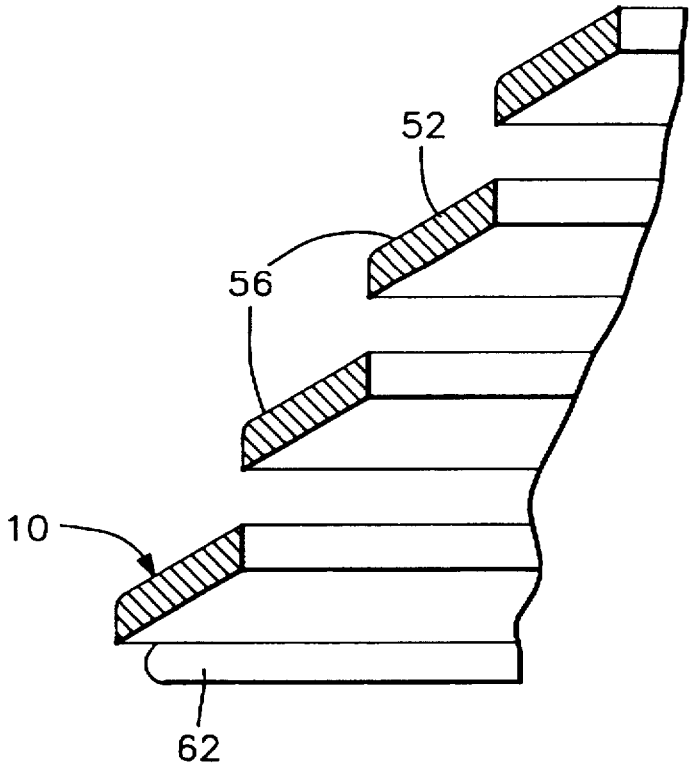
FIG. 5 is a fragmentary enlarged vertical sectional view of the rear end of the vent construction of FIG. 1 illustrating the louvered vent openings thereof.

The panel member 12 is bowed or arched transversely of its longitudinal center line extending centrally through the apex 14 defining an outer convex surface 21 and an inner concave surface 23 (see FIG. 4). The panel member 12 also has a generally V-shaped slot 20 formed therein which includes rearwardly divergent legs 22 and 24 that are spaced inwardly of and substantially parallel to side edges 16 and 18. The slot 20 generally divides the main panel 12 into a generally triangular central section 25 and a peripheral section 27.

The side edges of the central section 25 which define the inner margins of the slot legs 22 and 24 are formed to provide a sharpened edge, and preferably toothed or serrated as at 28. The apex 30 of the central section 25 defined by the intersection of the legs 22 and 24 of the slot 20 is sharpened as at 32. The rear ends of the legs 22 and 24 of the slot 20 include opposing inwardly directed extensions 34 and 36, while the extreme rear portion of the panel member 12 preferably includes upward projections 38 and 40 which define oppositely outwardly facing abutment surfaces 42 and 44 substantially in alignment with the rear ends of slot legs 22 and 24. Further, the central section 25 of the panel member 12 defined between slot legs 22 and 24 preferably includes a forward upwardly projecting and rounded longitudinal rib or ridge 50 closely behind the inner apex portion 30.

It will be noted from FIGS. 1, 2, 3 and 5 of the drawings that at the rear of the main panel member 12, the body structure 11 includes a rear panel generally designated by the numeral 48. In the preferred embodiment, rear panel 48 comprises rearwardly convergent and downwardly directed opposite side walls 52 and 54 which are preferably louvered as at 56 to provide openings in the rear wall. A central rearwardly and downwardly directed rib 58 interconnects the rear opposite side walls 52 and 54. In addition, a central depending rear fin or rib 60 projects downwardly from the underside 23 of the rearmost central portion of the panel member 12 forward of the side walls 52 and 54 of the rear panel 48. Also, the side edges 16 and 18 as well as the apex 14 preferably include a peripherally extending and downwardly projecting rounded bead 62.

In operation, a flexible cover sheet 64 with which the push-in vent 10 is to be operatively associated includes a cover sheet section 66 having an outer surface 68 and an inner surface 70. The cover vent 10 is placed over and in sliding contact with the outer surface 68, such as by a vent installer holding the vent 10 between the thumb and second finger. Typically, the vent can be held by the installer's thumb and second finger engaged with the abutment surfaces 42 and 44, respectively. This engagement leaves the installer's forefinger extending toward the apex 30 over the outer convex surface 21 of the central section 25. By applying slight downward pressure on the central section 25, as by the installer's forefinger, the apex 30 is depressed slightly downward relative to the peripheral portion 27 and the apex 14. The pointed apex 30 can thus engage with the outer surface 68 of the cover section 66, and the vent 10 is pushed forwardly in the direction of the apex 30 (upwardly in FIG. 1).

Forward movement of the apex 30 relative to the cover sheet section 66 causes the latter to be pierced by the apex sharpened point 32 and the apex 30 to reach the inner surface 70 of cover section 66. Then, as the central section 25 continues to advance further relative to the cover sheet section 66, the serrated side edges of section 25 along slot legs 24 cut a slit opening in the cover sheet section 66. The slit opening is shown in FIG. 3 with opposed longitudinal edges 72 and 74.

Figure 3:
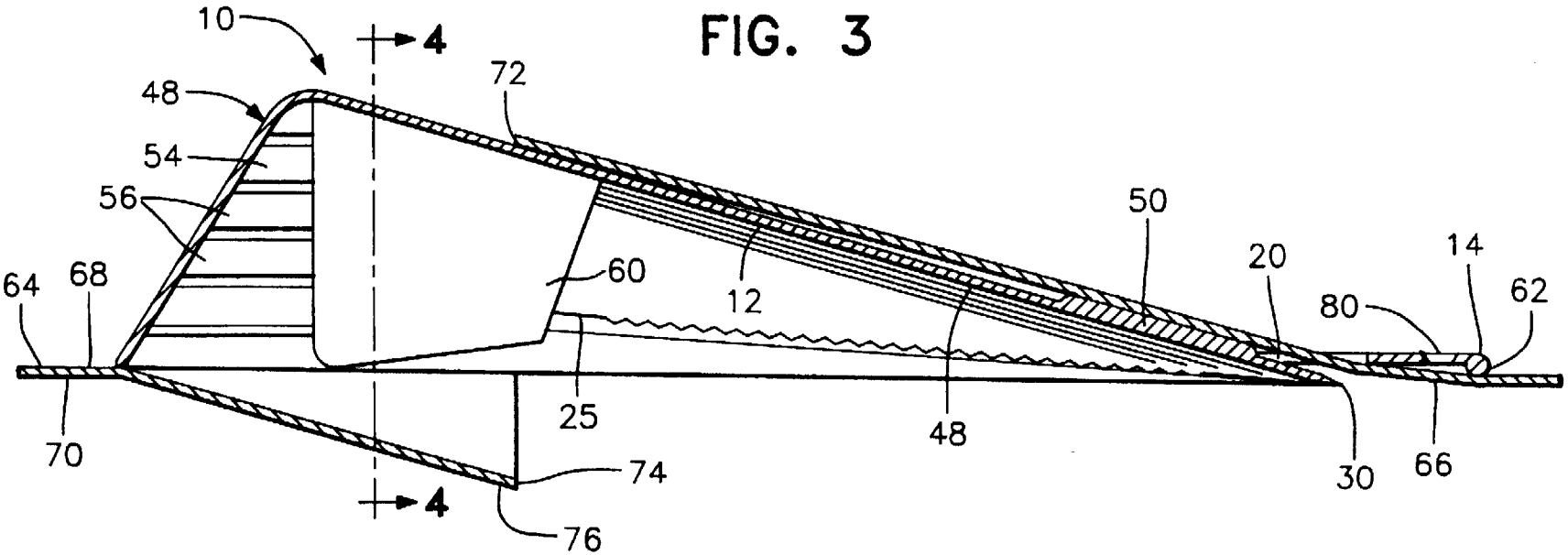
FIG. 3 is a longitudinal vertical sectional view of the vent construction of FIG. 1 as installed in a flexible cover sheet portion.

As shown in FIG. 3, forward movement of the vent 10 causes the portion of the cover sheet section 66 defined by the edge 72 to slide upward and over the central section 25. As the vent is moved forwardly, inward pressure is exerted on the panel member 12 in order to decrease the radius of curvature of the panel member 12, until the ends of the slit formed in the cover sheet section 66 reach the extensions 34 and 36. This inward pressure can readily be exerted by the installer's thumb and second finger on the abutment surfaces 42 and 44. At this point in the installation, the inward pressure on the panel member 12, such as by the installer's thumb and second finger on the abutment surfaces 42 and 44, is released. By this installation, the ends of the slit edge 72 in the cover section 66 are releasably locked into the adjacent ends of the extensions 34 and 36.

At this point, the vent 10 is now installed in the cover 64. Release of the downward pressure on the central section 25 allows the central section to move back into near alignment with peripheral section 27 thus engaging the cover section 66 in the slot legs 22 and 24. This engagement of the cover section 66 in the slot legs 22 and 24, coupled with the locking of the ends of slit edge 72 in slot extensions 34 and 36, holds the vent 10 in position in the cover portion 66. The fin or rib 60 also ensures that the bowed portion 76, see FIGS. 3 and 4, of the flexible cover 64 defined by the edge 74 is deflected inwardly to maintain spacing between the edges 72 and 74, and keep the slit open. In this manner, maximum ventilation through the louvered side walls 52 and 54 is assured.

The rounded bead 62 ensures that the peripheral edges of the vent 10 will not abraid the flexible cover 64. Further, the rib or ridge 50 on top of center section 25 maintains that portion of the cover section 66 adjacent the sharpened apex 30 spaced from the pointed end 32, see FIG. 3. This spacing tends to prevent abraiding of the cover 64 by the pointed end 32. Although not necessary, sewing, liquid adhesive and/or plastic pop rivets through the opening 80 in the apex 14 may be used to lock the vent 10 in position on the flexible cover 64 against removal therefrom.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a flexible cover sheet having an elongated slit opening formed therein and an air circulation vent comprising a resilient generally triangular panel member having convergent side edges and a first apex facing in a forward direction, said panel member having a generally V-shaped slot formed therein including convergent legs generally paralleling said side edges, said V-shaped slot defining a generally triangular central section and a peripheral section around said central section, said central section having side edges tapering toward a second apex inward of said first apex, said second apex being slightly deflectable relative to said peripheral section for insertion through said slit from one side of said cover section while said apex remains on and slides, in said forward direction, over said one side of said cover section.

2. The combination of claim 1 wherein the panel member of said circulation vent is arched transversely of said forward direction.

3. The combination of claim 1 wherein said first apex is rounded.

4. The combination of claim 1 wherein the side edges of said central section are sharpened.

5. The combination of claim 4 wherein said sharpened side edges, at least adjacent said second apex, are serrated.

6. The combination of claim 1 wherein said central section, generally along a path bisecting said second apex, includes an outwardly projecting ridge adjacent said second apex.

7. The combination of claim 1 wherein said panel member, generally along a path bisecting said second apex, includes a projection extending outward from the concave side of said panel member to retain said slit in an open condition.

8. The combination of claim 1 wherein said legs of said V-shaped slot include opposing inwardly directed terminal end portions remote from said second apex in which to receive edge portions of one of said sheet adjacent said slit opening.

9. The combination of claim 8 wherein said panel member is arched transversely of said forward direction and can be compressed to reduce a radius of curvature of said transverse arch in order to assist the receipt of the edge portions of said sheet adjacent said slit openings in said terminal end portions of said V-shaped slot.

10. The combination of claim 1 wherein said generally central section including said second apex is slightly deflectable relative to the remainder of said panel member.

11. The vent of claim 1 wherein said body structure includes a generally vertical rear ventilating panel.

12. The vent of claim 11 wherein said rear ventilating panel has louvered openings.

13. An air circulation vent for a flexible cover which comprises a one-piece resilient body structure having a forward end and a generally V-shaped slot which defines a generally triangular central section and a peripheral section around said central section, said central section having side edges which converge toward a sharpened apex inward of said forward end, at least said central section being arched transversely and said sharpened apex being slightly deflectable relative to said peripheral section in order to pierce said flexible cover and form a slit therein as said vent is moved forwardly.

14. The vent of claim 13 wherein the side edges of said central section are sharp in order to assist in forming the slit in said flexible cover as said vent is moved forwardly.

15. The vent of claim 14 wherein said side edges, at least adjacent said apex, are serrated.

16. The vent of claim 13 wherein said panel member, generally along a path bisecting said apex, includes a projection extending outward from the concave side of said panel member.

17. The vent of claim 16 wherein said central section, generally along a path bisecting said apex, includes an outwardly projecting ridge adjacent said apex.

18. The vent of claim 13 wherein said panel member is generally triangular in shape with divergent side edges and an apex at said forward end, and the side edges of said central section generally paralleling the side edges of said panel member.

19. The vent of claim 13 wherein said body structure includes a generally vertical rear ventilating panel.

20. The vent of claim 19 wherein said rear ventilating panel has louvered openings.

* * * * *